US011134555B1

(12) United States Patent
Shao

(10) Patent No.: US 11,134,555 B1
(45) **Date of Patent: *Sep. 28, 2021**

(54) POWER CABLE FOR LIGHT STRING AND POWER SUPPLY DEVICE

(71) Applicant: Blooming International Limited, The Valley (AI)

(72) Inventor: Shu-Fa Shao, The Valley (AI)

(73) Assignee: BLOOMING INTERNATIONAL LIMITED, The Valley (AI)

( * ) Notice: Subject to any disclaimer, the term of this patent is extended or adjusted under 35 U.S.C. 154(b) by 0 days.

This patent is subject to a terminal disclaimer.

(21) Appl. No.: 17/249,880

(22) Filed: Mar. 17, 2021

(51) Int. Cl.

| | |
|---|---|
| ***H05B 47/185*** | (2020.01) |
| ***F21V 23/02*** | (2006.01) |
| ***H01B 9/00*** | (2006.01) |
| ***F21S 4/10*** | (2016.01) |
| ***F21V 23/00*** | (2015.01) |

(52) U.S. Cl.
CPC ..... *H05B 47/185* (2020.01); *F21S 4/10* (2016.01); *F21V 23/003* (2013.01); *F21V 23/026* (2013.01); *H01B 9/006* (2013.01)

(58) Field of Classification Search
CPC ..... F21Y 2115/10; F21Y 2113/13; F21Y 2113/10; F21Y 2113/17; F21V 23/001; F21V 19/0025; F21V 19/002; F21V 19/005; F21V 23/003; F21V 23/02; F21V 31/005; F21V 9/08; F21V 23/00; F21V 23/04; F21V 23/0407; F21S 4/26; F21S 4/10; F21S 4/22; F21S 4/00; H05B 45/10; H05B 45/00; H05B 45/325; H05B 45/37; H05B 45/46; H05B 47/105
See application file for complete search history.

(56) References Cited

U.S. PATENT DOCUMENTS

| | | | | |
|---|---|---|---|---|
| 9,781,781 | B2 | 10/2017 | Huang et al. | |
| 10,165,638 | B1 * | 12/2018 | Wang | H05B 39/044 |
| 10,980,094 | B1 * | 4/2021 | Chang | H05B 45/10 |
| 10,989,374 | B1 * | 4/2021 | Chen | A47G 33/08 |

* cited by examiner

*Primary Examiner* — Monica C King
(74) *Attorney, Agent, or Firm* — McClure, Qualey & Rodack, LLP

(57) ABSTRACT

A power cable for a light string includes two wires, a body and a switching circuit. The two wires extend from a first end to a second end. The body is disposed on the two wires. The switching circuit includes a normally open contact switch and a voltage dividing resistor. The normally open contact switch is connected in series with the voltage dividing resistor and is electrically connected to two wires. The normally open contact switch and the voltage dividing resistor are disposed in the body, and the normally open contact switch is at least partially exposed on the surface of the body. The normally open contact switch is configured to be repeatedly pressed, so that the voltage division state between the two wires changes to form a trigger signal combination.

16 Claims, 14 Drawing Sheets

POWER CABLE FOR LIGHT STRING AND POWER SUPPLY DEVICE

BACKGROUND

Technical Field

This disclosure relates to a transformer, in particular to a power cable and a power supply device for a light string.

Related Art

A light string is a string-like illumination device formed by plural light-emitting diodes connected in series, parallel or mixed series/parallel.

The light string is driven by PWM power provided by a transformer. Through the adjustment of the output voltage, frequency, and duty cycle, the brightness and flicker of the light-emitting diodes in the light string can be changed.

As shown in FIG. 1, the existing transformers is integrated into a single plug type, which is directly plugged into a household AC outlet, and the control circuit is also provided within the transformer, such as the transformer disclosed in U.S. Pat. No. 9,781,781B2. In the aforementioned transformer provided with the control circuit, the control circuit and the transformation circuit are both installed in the housing of the transformer; the switch is welded and fixed to the circuit board and exposed through the hole of the housing; a sealing film is covered on the hole to seal the switch. By pressing of the switch, the control circuit switches the output of the transformation circuit and outputs the corresponding PWM power to the load end. In the aforementioned transformers, the buttons/switches are integrated into the single-plug type transformer, so that the locations of the function buttons/switches are restricted by the transformer. When the user operates the transformer to switch, he/she has to operate it nearby to the household AC outlet, which is prone to electric shock. In addition, a single plug type transformer is not easily designed for waterproofing. For example, U.S. Pat. No. 9,781,781B2 uses a sealing film to cover the hole, however, the sealing film also needs to be repeatedly pressed and is easily damaged. That is to say, once the damp state occurs, leakage of the transformer is prone to occur, and the user is easily exposed to electric shocks during switching operations.

As shown in FIG. 2, another approach is to set the control circuit and buttons/switches independently in another housing to form an independent controller, and set the controller in the middle of the power cable or at any position. However, in this approach, in addition to the original power wires for transmitting power, additional control signal wires are required to transmit the control signals of the control circuit to the transformation circuit, which makes the overall wiring complicated.

SUMMARY

Based on the foregoing problems, this disclosure proposes a power cable and a power supply device for a light string, which are configured to change the switching operation.

At least one embodiment of this disclosure provides a power cable for a light string, which includes two wires, a body, and a switching circuit. The two wires extend from a first end to a second end. The body is disposed on the two wires. The switching circuit includes a normally open contact switch and a voltage dividing resistor. The normally open contact switch is connected in series with the voltage dividing resistor and is electrically connected to two wires. The normally open contact switch and the voltage dividing resistor are disposed in the body, and the normally open contact switch is at least partially exposed on a surface of the body. The normally open contact switch is configured to be repeatedly pressed, so that the voltage division state between the two wires changes to form a trigger signal combination.

In at least one embodiment, the body is disposed at one of the first end or the second end.

In at least one embodiment, the power cable for the light string includes two contact electrodes, at least partially disposed on the body and exposed on the surface of the body, and the two contact electrodes are respectively connected to the two wires.

In at least one embodiment, the body is disposed between the first end and the second end.

In at least one embodiment, the power cable for the light string further includes a pair of bidirectional diodes, connected in parallel in two bias directions and arranged on one of the two wires, and located between the voltage divider resistor and the second end.

At least one embodiment of this disclosure also provides a power supply device for a light string, which includes the power cable as described above and a transformer. The transformer includes a transformation circuit and a control circuit. The transformation circuit includes an input terminal and an output terminal. The transformation circuit receives external power from the input terminal and converts the external power into driving power, outputs the driving power through the output terminal. The first end of the power cable is electrically connected to the output terminal. The control circuit is electrically connected to the transformation circuit, and is electrically connected to the two wires through the first end and the output terminal; the control circuit detects the voltage division state between the two wires, and according to the voltage division state sends a switching signal to the transformation circuit to change the driving power, wherein the driving power is a pulse width modulation signal, and the switching signal is configured to change the duty cycle of the pulse width modulation signal.

In at least one embodiment, the transformer further includes a housing and at least two metal sheets. The transformation circuit and the control circuit are disposed in the housing, and the metal sheets protrude from a surface of the housing and are connected to the input terminal.

In at least one embodiment, the control circuit includes a power management chip, a switching controller, and a decoder; the switching controller is electrically connected to the power management chip and the decoder, and obtains working power from the power management chip; the decoder is connected to two wires, the normally open contact switch is configured to be repeatedly pressed to change the voltage division state between the two wires to form a trigger signal combination, and the decoder is configured to analyze each trigger signal combination and send corresponding information to the switching controller, so that the switching controller sends a switching signal to the transformation circuit to change the driving power according to the trigger signal combination.

In at least one embodiment, the control circuit further includes a remote control signal receiver connected to the switching controller; the remote control signal receiver is configured to receive a plurality of remote control selection signals and transmit the remote control selection signals to the switching controller; each remote control selection signal corresponds to a switching mode which enables the switching controller to send the switching signal to the transformation circuit to change the driving power.

In at least one embodiment, the transformation circuit further includes an inverter, corresponding to the input terminal, and configured to convert the external power into a direct current, and the power management chip is electrically connected to the inverter to change a voltage of the direct current to output the direct current to be the driving power.

In this disclosure, the position of the switching circuit is moved to the power cable and separated from the transformer. Therefore, the user does not need to operate on the transformer to switch the output of the transformer, and the danger of high-voltage electric shock is avoided. At the same time, the switching circuit can be easily provided with waterproof measures, such as being covered with plastic film or waterproof glue, to reduce the risk of electricity leakage of the switching circuit due to moisture.

BRIEF DESCRIPTION OF THE DRAWINGS

This disclosure will become more fully understood from the detailed description given herein below for illustration only, and thus not limitative of this disclosure, wherein.

DETAILED DESCRIPTION

Figure 1:
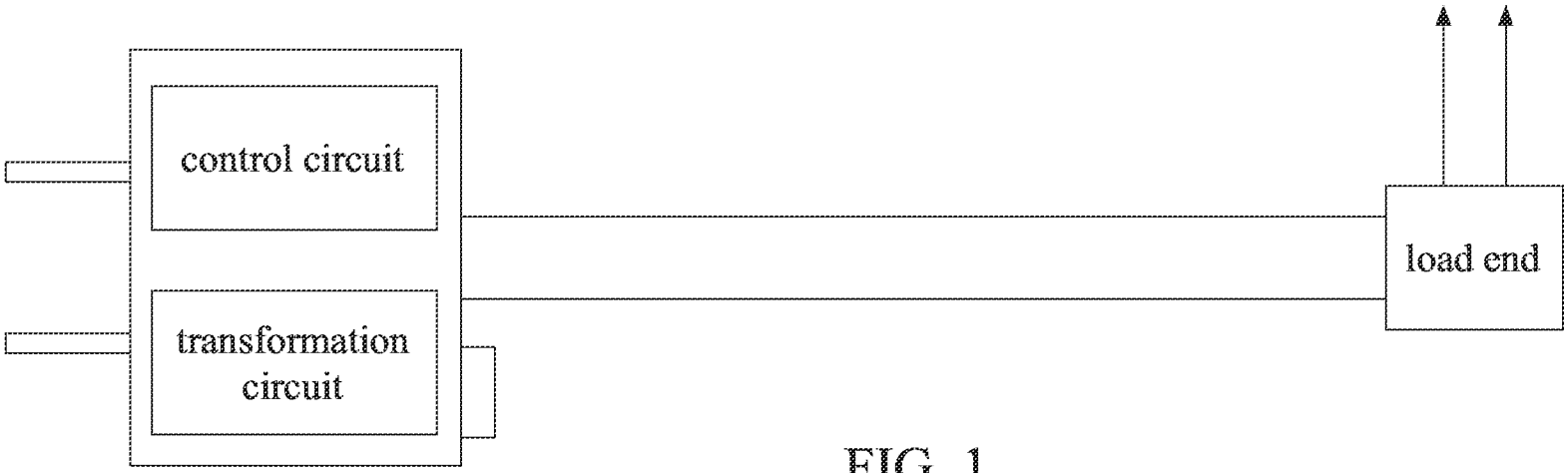
FIG. 1 (Prior Art)
FIG. 1 is a schematic diagram of a power supply device for a light string in the prior art.
Figure 2:
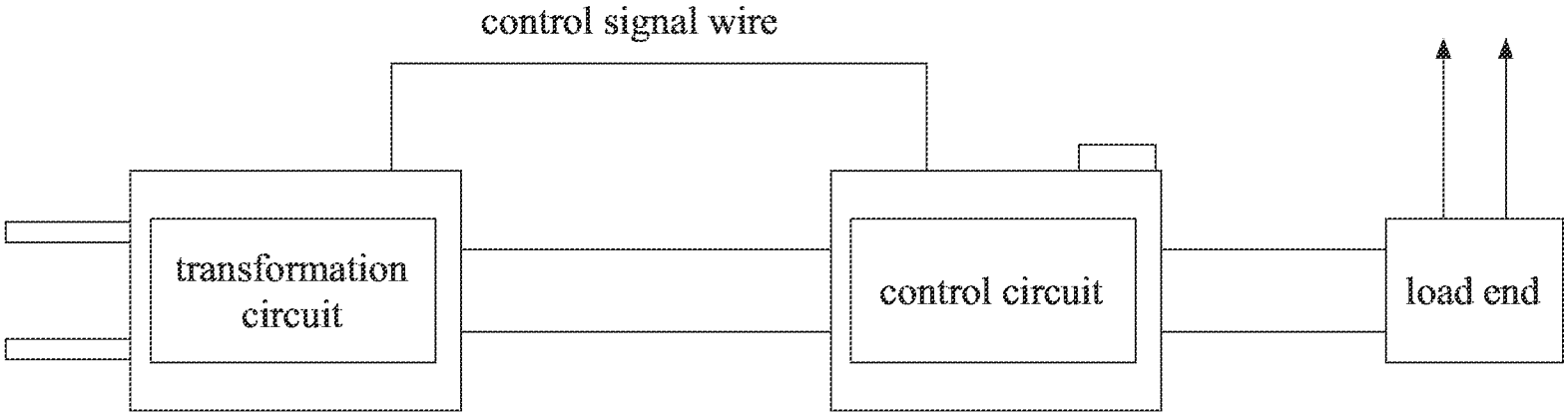
FIG. 2 (Prior Art)
FIG. 2 is a schematic diagram of another power supply device for a light string in the prior art.
Figure 3:
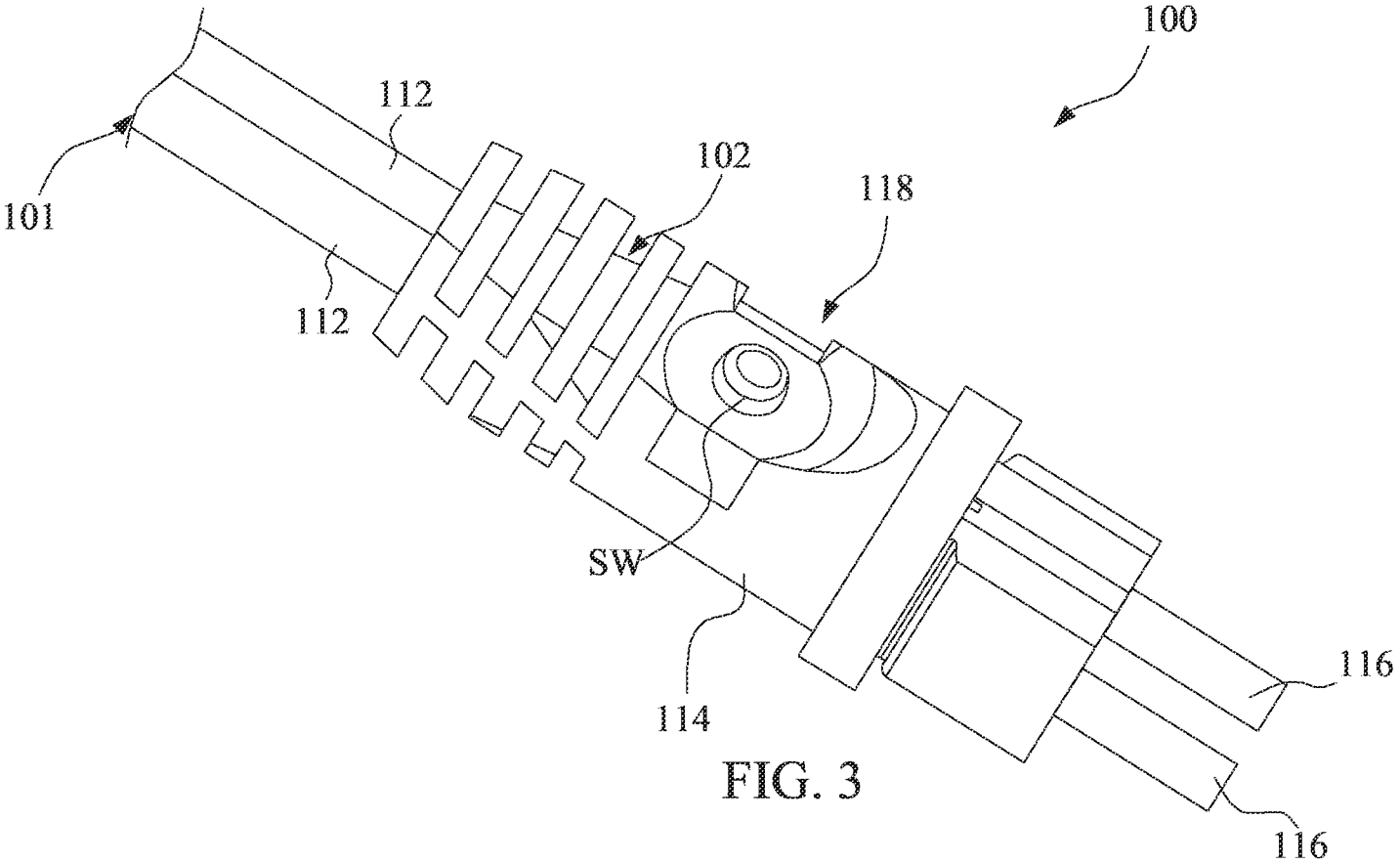
FIG. 3 is a perspective view of a power cable for a light string according to a first embodiment of this disclosure.
Figure 4:
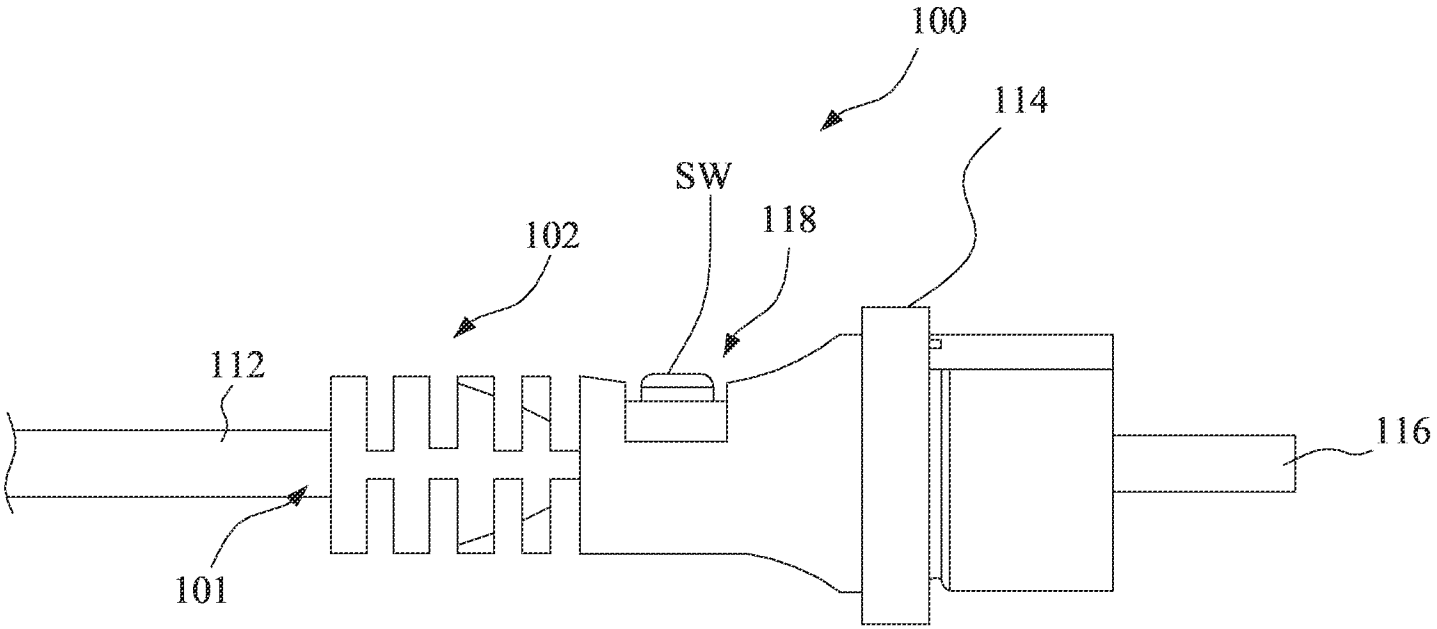
FIG. 4 is a side view of the power cable for the light string according to the first embodiment of this disclosure.
Figure 5:
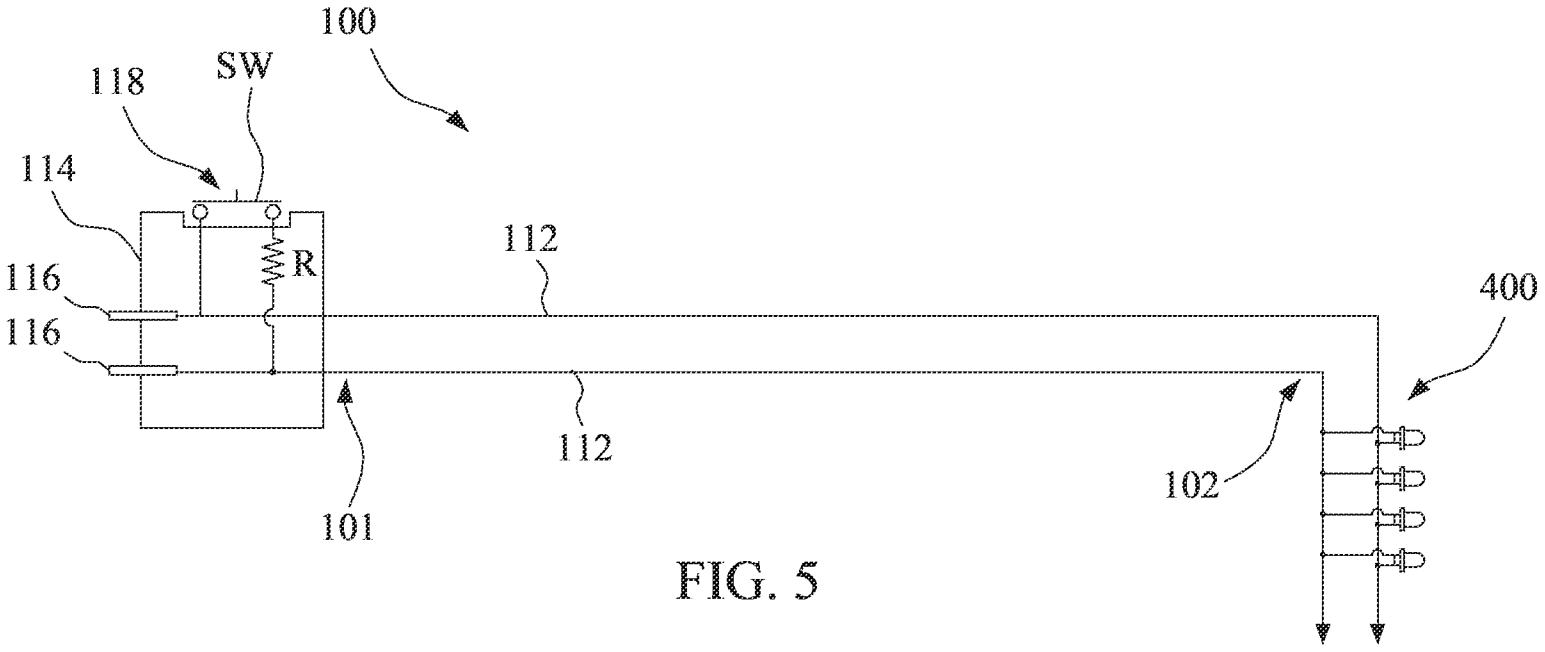
FIG. 5 is a circuit block diagram of the power cable for the light string according to the first embodiment of this disclosure.

Please refer to FIG. 3, FIG. 4, and FIG. 5, a power cable 100 for a light string 400 is disclosed according to a first embodiment of this disclosure. The power cable 100 includes at least two wires 112, at least one body 114, at least two contact electrodes 116, and at least one switching circuit 118. The power cable 100 includes a first end 101 and a second end 102. The two wires 112 respectively extend from the first end 101 to the second end 102. The switching circuit 118 is disposed in the body 114, and the body 114 is disposed on the two wires 112, so that the switching circuit 118 is electrically connected to the two wires 112. The body 114 and the switching circuit 118 may be located at one of the first end 101 or the second end 102. It is not excluded that the number of the body 114 and the switching circuit 118 is two respectively, which are respectively disposed at the first end 101 or the second end 102, or disposed at any position between the first end 101 and the second end 102. In this embodiment, one body 114 and one switching circuit 118 are provided at the second end 102 for illustration.

As shown in FIGS. 3, 4, and 5, the two contact electrodes 116 are at least partially disposed on the body 114, and the two contact electrodes 116 are respectively connected to the two wires 112 and exposed on a surface of the body 114; that is, the contact electrodes 116 is combined with the body 114 to form a male plug. In one specific embodiment, the contact electrode 116 is needle-shaped or sheet-shaped, partially embedded in the body 114, and other parts protrude from the surface of the body 114. In different embodiments, each of the contact electrodes 116 is tubular and is embedded in the body 114, and the opening of the hollow tubular space of the contact electrode 116 is located on the surface of the body 114.

As shown in FIG. 5, the switching circuit 118 includes a normally open contact switch SW and a voltage dividing resistor R. The normally open contact switch SW can be, but is not limited to, a micro switch, a capacitor switch or a membrane switch. The normally open contact switch SW is connected in series with the voltage dividing resistor R and is electrically connected to the second wire 112. The normally open contact switch SW and the voltage divider resistor R are disposed in the body 114, and the normally open contact switch SW is at least partially exposed on the surface of the body 114. The normally open contact switch SW is configured to be pressed to cause a voltage division between the two wires 112. The normally open contact switch SW is configured to be repeatedly pressed to change the voltage division state between the two wires 112 to form a trigger signal combination.

Figure 6:
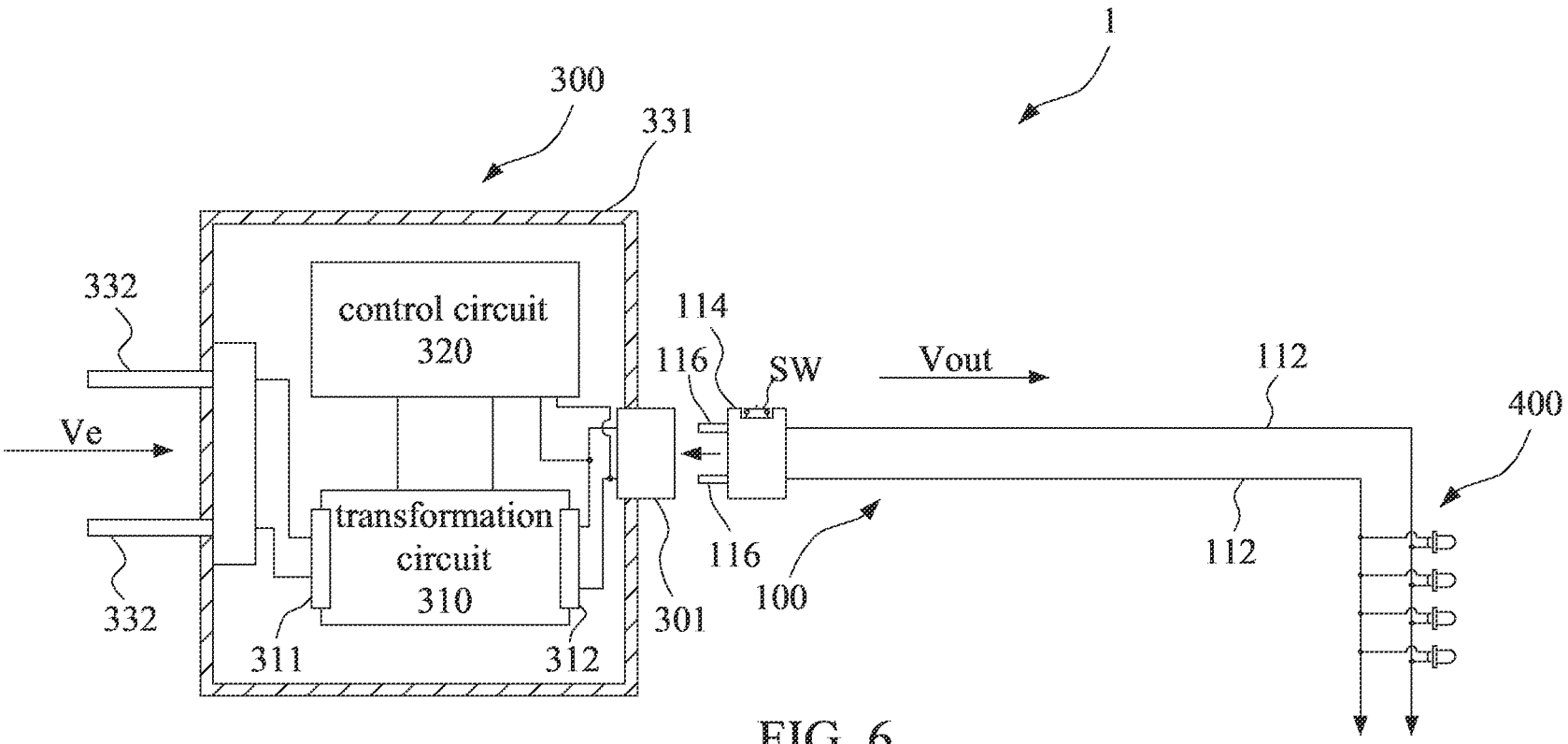
FIG. 6 is a circuit block diagram of the power supply device for the light string according to the first embodiment of this disclosure.

Referring to FIG. 6, the first embodiment of this disclosure further discloses a power supply device 1 for a light string 400, which includes the aforementioned power cable 100 and a transformer 300.

As shown in FIG. 6, the first end 101 of the wire 112 is connected to the transformer 300 through the body 114 and the contact electrode 116. However, this disclosure does not exclude the provision of only one set of body 114 and contact electrodes 116; for example, the second end 102 is connected to the light string 400 through the body 114 and the contact electrode 116, and the first end 101 is directly connected to the circuit of the transformer 300 by welding.

As shown in FIG. 6, the transformer 300 includes a transformation circuit 310 and a control circuit 320. The transformation circuit 310 includes an input terminal 311 and an output terminal 312. The transformation circuit 310 receives the external power Ve from the input terminal 311 and converts the external power Ve into the driving power Vout, and the transformation circuit 310 outputs the driving power Vout through the output terminal 312. The first end 101 of the power cable 100 is electrically connected to the output terminal 312, and can output the driving power Vout to the second end 102 to drive the light string 400 to light up. Specifically, the contact electrode 116 is combined with the body to form a male plug. The output terminal 312 of the transformer 300 is provided with a socket 301. The male plug can be directly inserted into the socket 301 to achieve the connection between the power cable 100 and the transformer 300.

As shown in FIG. 6, the control circuit 320 is electrically connected to the transformation circuit 310 and the two wires 112. The control circuit 320 detects the voltage division state between the two wires 112 and sends a switching signal to the transformation circuit 310 to change the driving power Vout according to the voltage division state.

As shown in FIG. 6, the transformer 300 further includes a housing 331 and two or more metal sheets 332. The transformation circuit 310 and the control circuit 320 are disposed in the housing 331, and the metal sheet 332 protrudes from the surface of the housing 331 and is connected to the input terminal 311. Specifically, the metal sheet 332 is the pin of the AC power plug and can be inserted into the AC power socket to receive household AC power as the external power Ve.

The driving power Vout may be a pulse width modulation signal (Pulse Width Modulation, PWM) for driving the light string 400 to emit light. The control circuit 320 is configured to control the transformation circuit 310 to change the frequency, bandwidth, and PWM duty ratio of the driving power Vout, so as to adjust the average current output by the transformation circuit 310 and adjust the brightness of the light string 400.

In this disclosure, the control circuit 320 periodically detects the voltage division state between the two wires 112, and when the normally open contact switch SW is pressed the voltage difference between the two wires 112 is reduced, and divided voltage occurs between the two end of the voltage divider resistor, the divided voltage is regarded as receiving a trigger signal. The triggering times and duration of the trigger signal can form a coded trigger signal combination, which enables the control circuit 320 to send a switching signal to the transformation circuit 310 to change the frequency, voltage and PWM duty cycle of the driving power Vout to adjust the brightness or the flicker frequency of the light string 400. For example, a short press increases the brightness of the light string 400, while a long press reduces the brightness of the light string 400, a long press and a short press to switch the light string 400 to blink, and two long presses to switch the light string 400 to not blink, etc.

Figure 7:
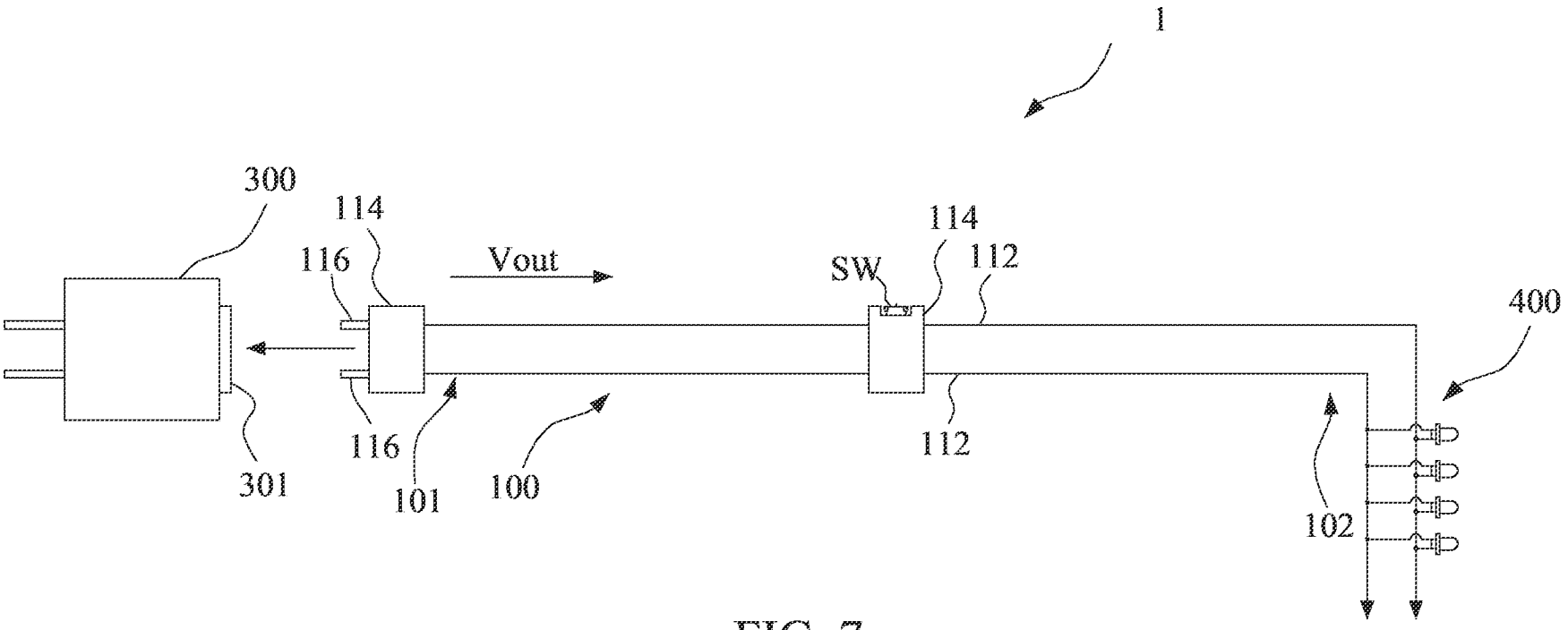
FIG. 7 is a circuit block diagram of the power supply device for the light string according to a second embodiment of this disclosure.

Referring to FIG. 7, a power cable 100 for the light string 400 according to a second embodiment of this disclosure is disclosed. In the second embodiment, the switching circuit 118 is not provided in the male plug of the power cable 100 (that is, the switching circuit 118 is not provided in the combination of the body 114 and the contact electrodes 116), but another body 114 is arranged in the middle section of the wire 112, and the switching circuit 118 is arranged on this additional body 114, so that the switching circuit 118 is away from the transformer 300. Therefore, the user can stay away from the transformer 300 when switching the output of the transformer 300 to avoid the danger of high-voltage electric shock.

Figure 8:
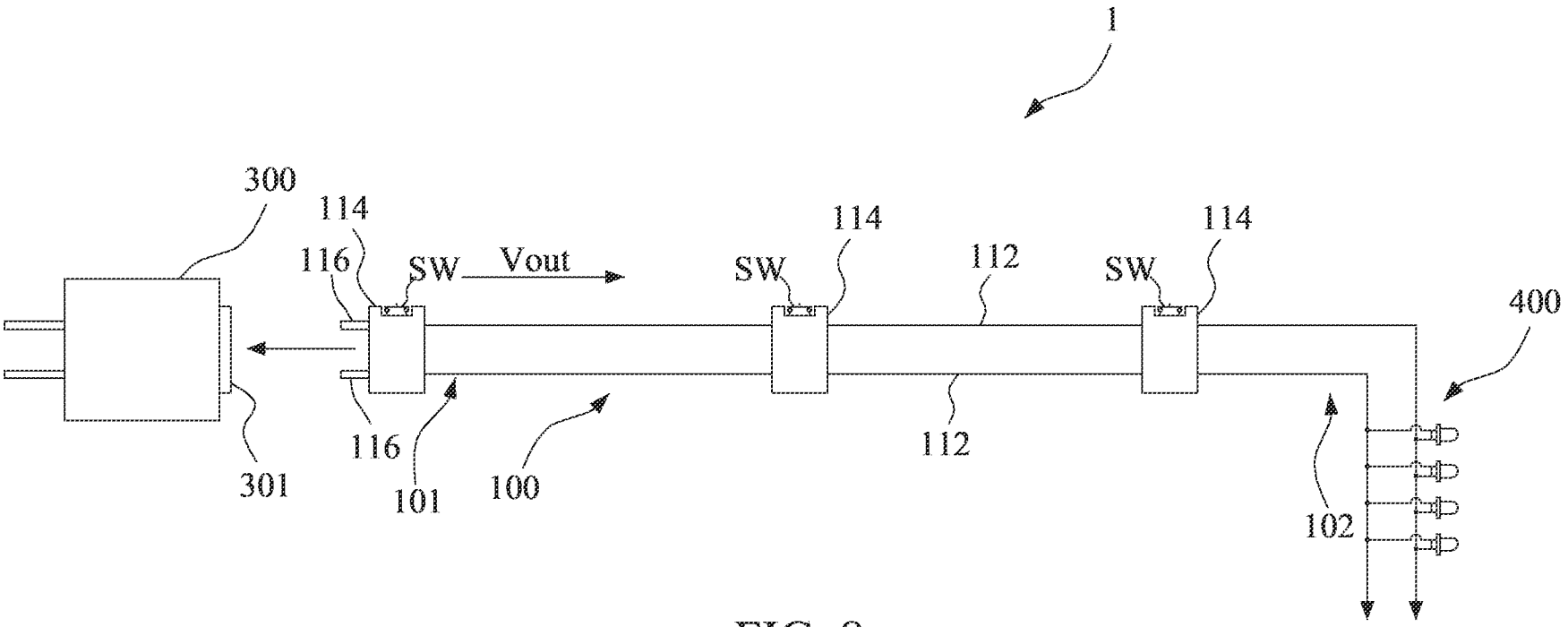
FIG. 8 is a circuit block diagram of a power supply device for a light string according g to a third embodiment of this disclosure.

Referring to FIG. 8, a power cable 100 for a light string 400 according to a third embodiment of this disclosure is disclosed. In the third embodiment, the power cable 100 includes a plurality of switching circuits 118 and a plurality of bodies 114, respectively disposed at any position on the power cable 100. The user can operate the switching circuit 118 in different positions to increase the convenience of switching the output of the transformer 300.

Figure 9:
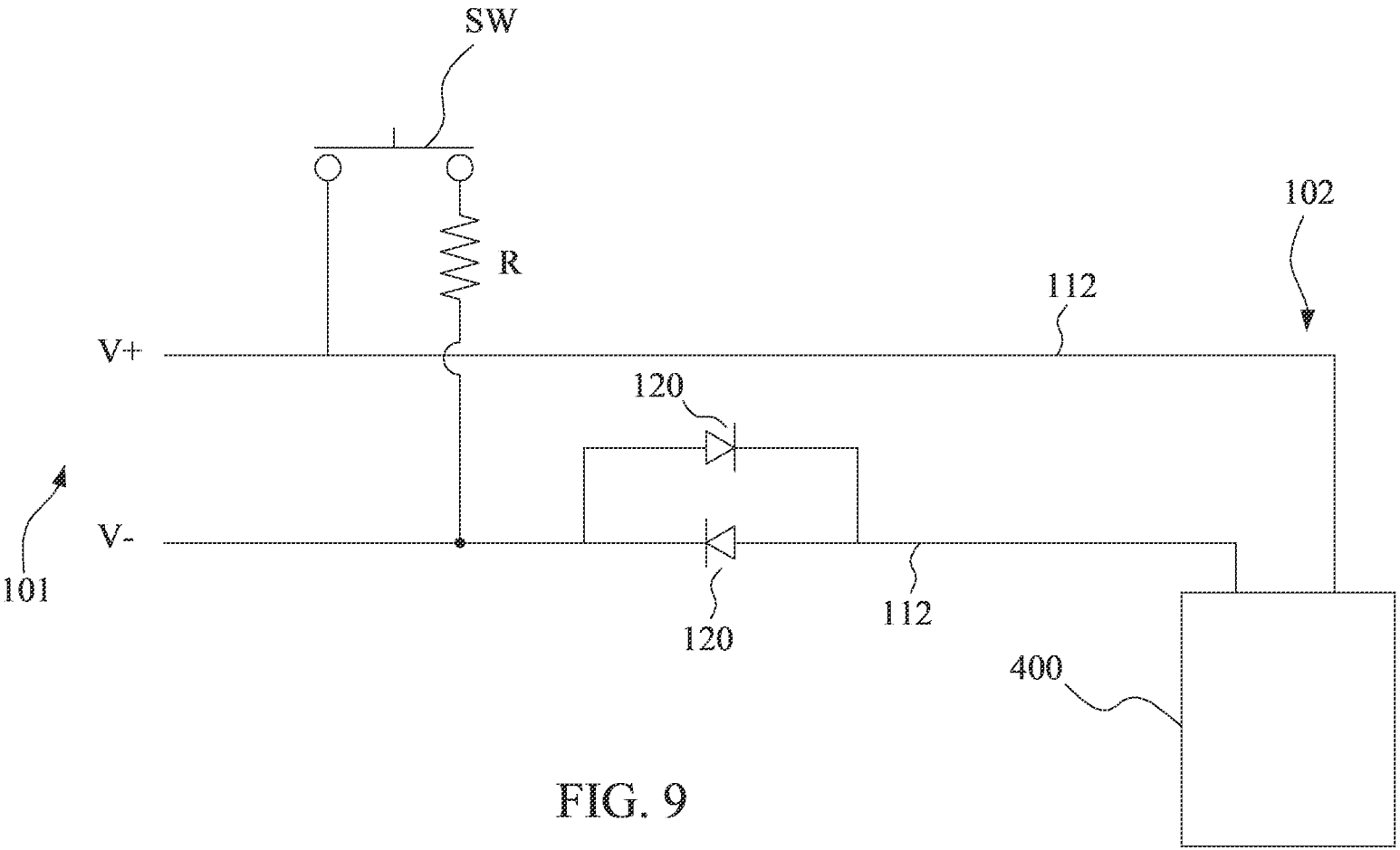
FIG. 9 is a circuit diagram of a power supply device for a light string according to a fourth embodiment of this disclosure.

Please refer to FIG. 9, a power cable 100 for the light string 400 according to a fourth embodiment of this disclosure is disclosed. The body 114 and the two contact electrodes 116 are omitted in the drawings, and only the two wires 112 and the switching circuit 118 are shown for illustration. The power supply device of the fourth embodiment further includes a pair of bidirectional diodes 120, which are connected in parallel in two bias directions and arranged on one of the two wires 112, and are located between the voltage divider R of the switching circuit 118 and the second end 102 of the light string 400. Since a voltage difference between the diodes 120 can be fixed, when the normally open contact switch SW is pressed, the voltage difference/divided state of the two wires 112 at the first end 101 can be fixed, for example, maintained at 0.7V, so that the control circuit 320 can normally determine whether the normally open contact switch SW is pressed. Therefore, when the light string 400 is partially malfunctioned, such as a partial failure of the light string 400 or an occurrence of a leakage of the light string 400, it will not affect the voltage division state between the two wires 112 after the normally open contact switch SW is pressed. The voltage division state, which is turned on by the voltage dividing resistor R, between the two wires 112 maintains a fixed voltage difference. In this way, it is possible to avoid the situation that the light string 400 is partially malfunctioned to cause the control circuit 320 of the transformer 300 to be unable to detect the voltage difference or to make a wrong detection.

Figure 10:
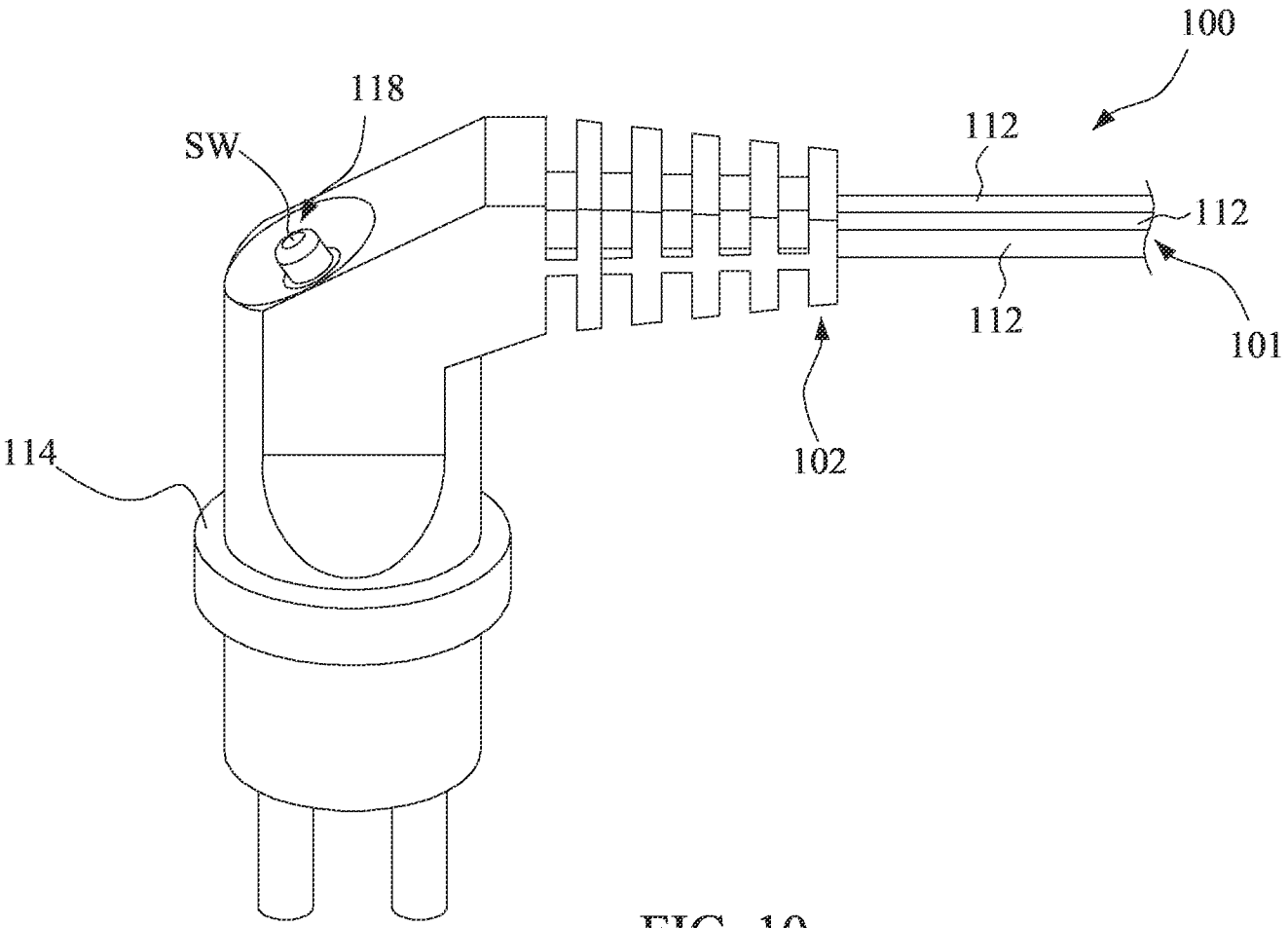
FIG. 10 is a perspective view of the power cable for the light string according to a fifth embodiment of this disclosure.
Figure 11:
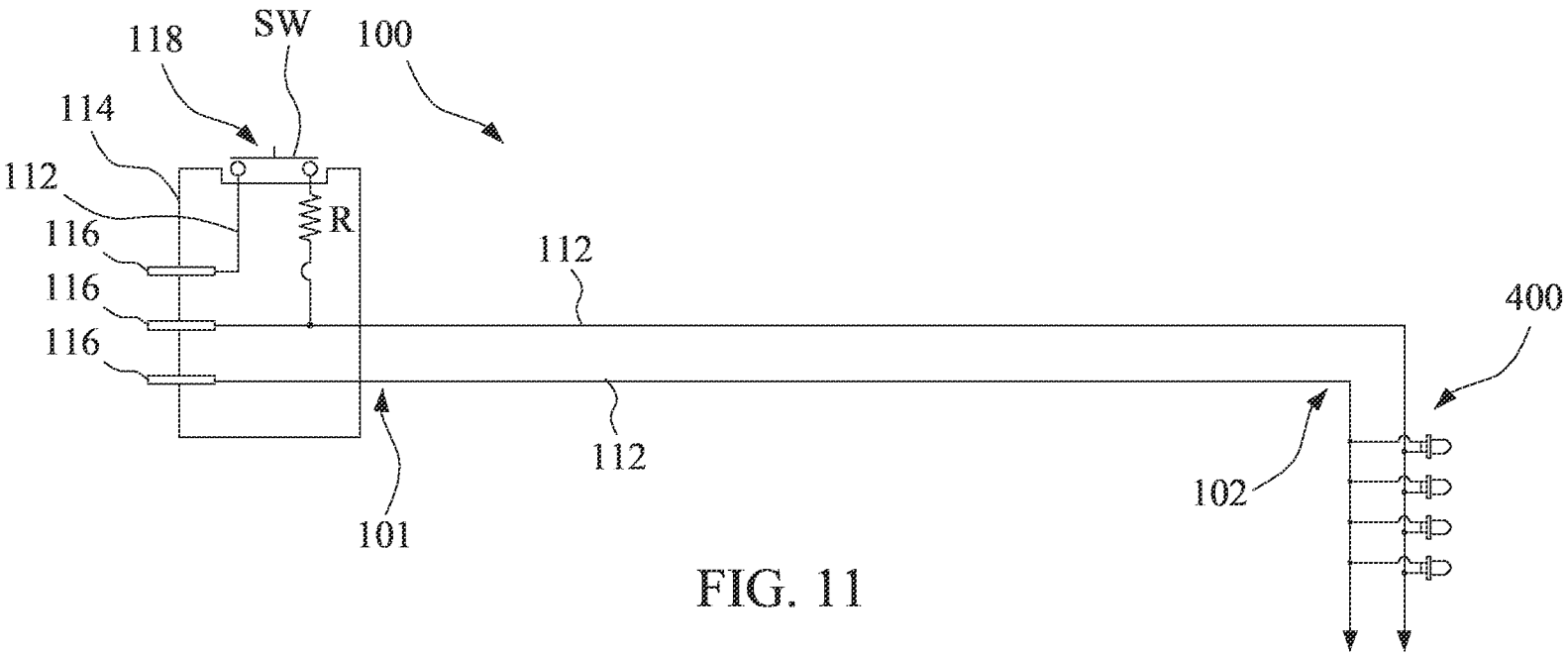
FIG. 11 is a circuit block diagram of a power supply device for a light string according to the fifth embodiment of this disclosure.

Please refer to FIGS. 10 and 11, a power cable 100 for a light string 400 according to a fifth embodiment of this disclosure is disclosed. The power cable 100 includes a plurality of wires 112, at least one body 114, three contact electrodes 116, and at least one switching circuit 118. The difference between the fifth embodiment and the foregoing embodiments is that the number of wires 112 is not necessarily two, and there may be three or more than three wires. Among them, the two wires 112 are configured to transmit power, and the other wire 112 is only provided in the body 112 and is connected to one of the other two wires 112 through the switching circuit 118. The control circuit 320 detects the voltage drop caused by the switching circuit 118 being pressed.

Figure 12:
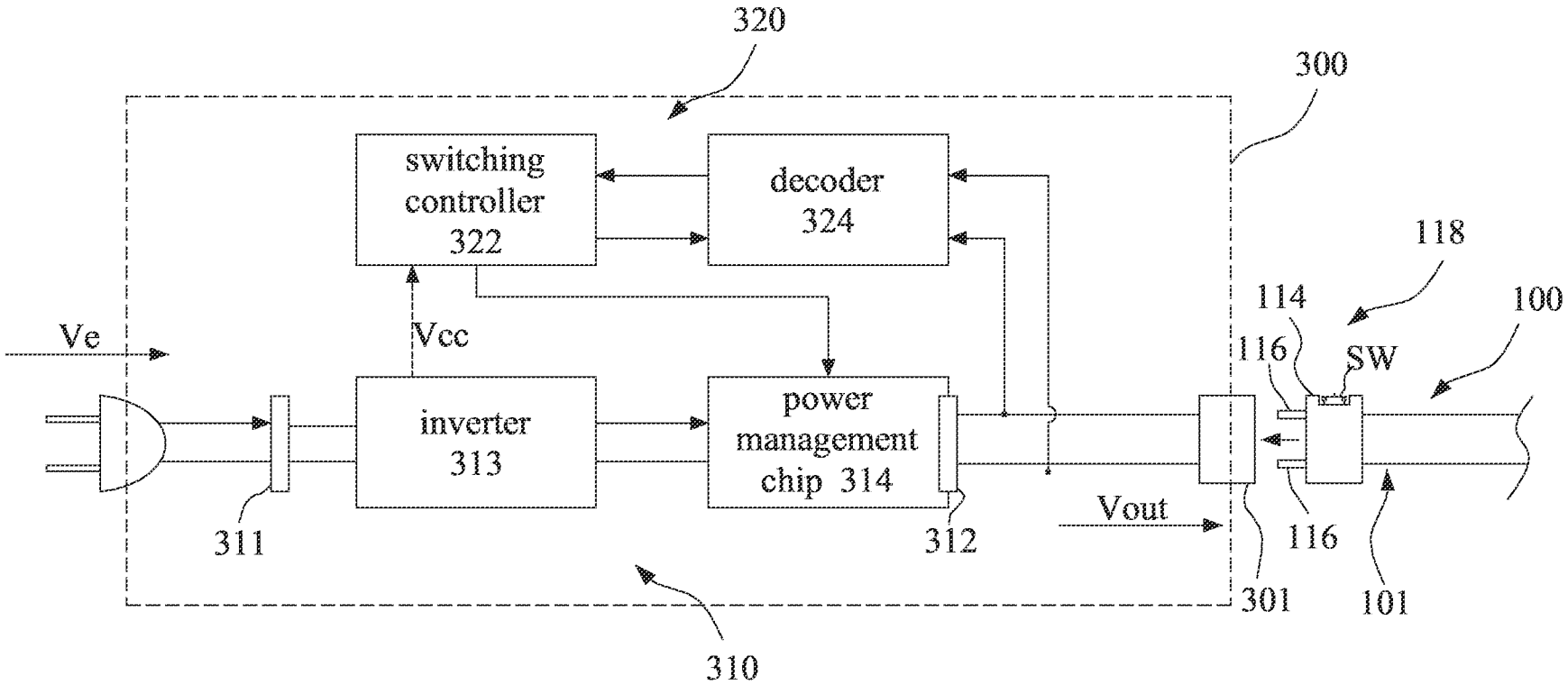
FIG. 12 is a circuit block diagram of a transformer in one or more embodiments of this disclosure.

As shown in FIG. 12, in one or more of the foregoing embodiments, the transformation circuit 310 includes an inverter 313 and a power management chip 314 (Power IC). The inverter 313 can be a winding set or a bridge rectifier circuit. The inverter 313 is arranged corresponding to the input terminal 311 and is configured to convert household AC power, which is the external power Ve, into DC power. The power management chip 314 is electrically connected to the inverter 313 and is arranged corresponding to the output terminal 312. The power management chip 314 is used as a power switch and to adjust the voltage of the DC power to output driving power Vout.

As shown in FIG. 12, the control circuit 320 includes a switching controller 322 and a decoder 324. The decoder 324 is connected to the two wires 112. The switching controller 322 is electrically connected to the power management chip 314 and the decoder 324, and obtains the working power Vcc from the inverter 313.

As shown in FIG. 12, the decoder 324 is configured to analyze the trigger signal combination. For example, the number of trigger signals and the trigger duration of the trigger signal can form a coded trigger signal combination.

The decoder 324 further transmits corresponding information to the switching controller 322, so that the switching controller 322 loads the corresponding switching mode according to the trigger signal combination. According to the switching mode, the switching controller 322 sends a switching signal to the transformation circuit 310 to change the frequency, bandwidth, or voltage of the driving power Vout, so as to adjust the brightness or blinking frequency of the light string 400.

Figure 13:
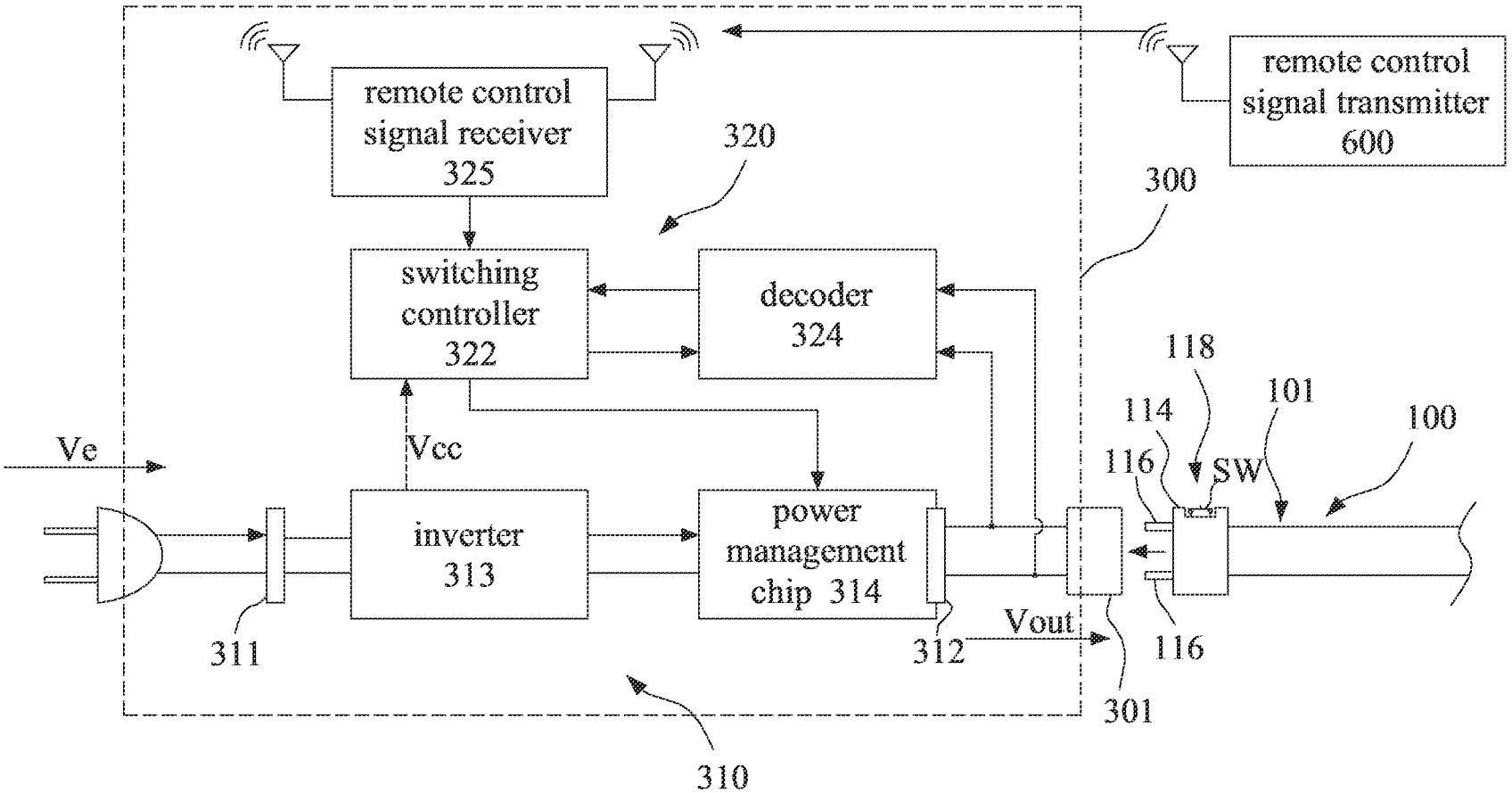
FIG. 13 is a circuit block diagram of a transformer in one or more embodiments of this disclosure.

Referring to FIG. 13, in one or more of the foregoing embodiments, the control circuit 320 further includes a remote control signal receiver 325 connected to the switching controller 322. The remote control signal receiver 325 is configured to receive a plurality of remote control selection signals from a remote control signal transmitter 600 and transmit remote control selection signals to the switching controller 322. Each remote control selection signal corresponds to one switching mode, so that the switching controller 322 sends a corresponding switching signal to the transformation circuit 310 to change the frequency, bandwidth, or voltage of the driving power Vout, so as to adjust the brightness or blinking frequency of the light string 400.

Figure 14:
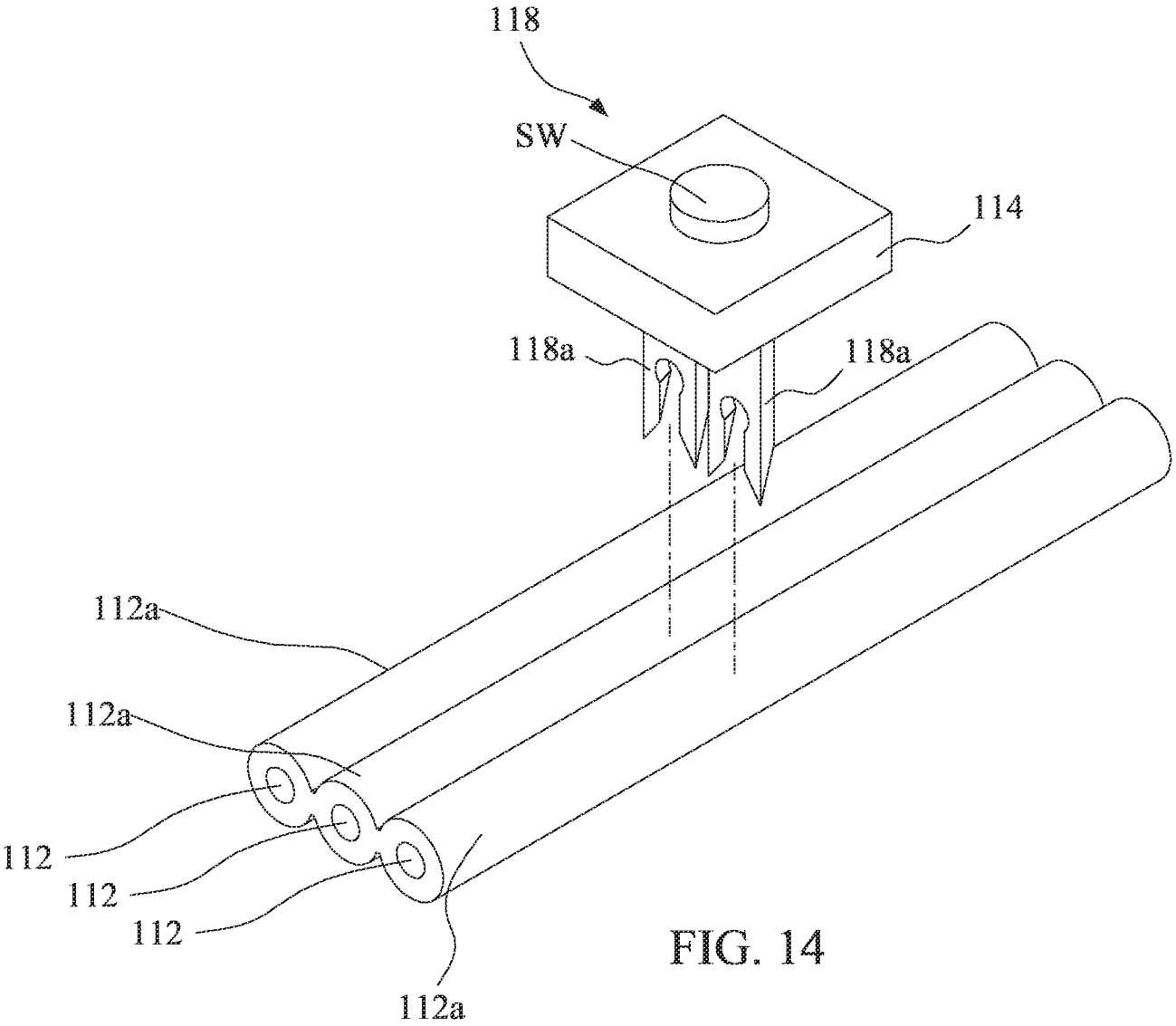
FIG. 14 is a perspective view of a wire and a switching circuit in one or more embodiments of this disclosure.

Referring to FIG. 14, in one or more of the foregoing embodiments, the surface of the wire 112 is further covered with an insulation layer 112*a*, and the plurality of insulation layers 112*a* may be partially connected, so that the wires 112 become a rubber-coated cable. The switching circuit 118 further includes two insulation displacement terminals 118*a*, which are respectively electrically connected to the normally open contact switch SW and the voltage dividing resistor R, and protrude from the body 114. The insulation displacement terminals 118*a* are configured to pierce the insulation layers 112*a*, so that the insulation displacement terminal 118*a* contacts two of the plurality of wires 112, and the switching circuit 118 is electrically connected to the two wires 112. Therefore, according to the structure shown in FIG. 14, the user can install the switching circuit 118 at any position of the wires 112 according to the requirements, or add the switching circuit 118 according to the requirements, and is not limited the original arrangement.

In this disclosure, the position of the switching circuit 118 is moved to the power cable 100 and is separated from the transformer 300. Therefore, the user does not need to operate switches on the on the transformer 300 to change the output of the transformer 300 so as to avoid the danger of high-voltage electric shock. At the same time, the switching circuit 118 can be easily provided with waterproof measures, such as being covered with plastic film or waterproof glue, to reduce the risk of leakage of the switching circuit 118 due to moisture.

What is claimed is:

1. A power cable for a light string, comprising:

two wires, extending from a first end to a second end;

a body, disposed on the two wires; and a switching circuit, including a normally open contact switch and a voltage dividing resistor; wherein the normally open contact switch is connected in series with the voltage dividing resistor and electrically connected to the two wires, the normally open contact switch and the voltage dividing resistor are disposed in the body, and the normally open contact switch is at least partially exposed on the surface of the body.

2. The power cable for a light string as claimed in claim 1, wherein the body is disposed at one of the first end or the second end.

3. The power cable for the light string as claimed in claim 2, further comprising two contact electrodes, at least partially disposed on the body and exposed on the surface of the body, wherein the two contact electrodes are respectively connected to the two wires.

4. The power cable for a light string as claimed in claim 1, wherein the body is disposed between the first end and the second end.

5. The power cable for the light string as claimed in claim 1, further comprising a pair of bidirectional diodes, connected in parallel in two bias directions and arranged on one of the two wires, and located between the voltage dividing resistor and the second end.

6. A power supply device for light strings, comprising:

the power cable according to claim 1; and a transformer, comprising:

a transformation circuit, including an input terminal and an output terminal, wherein the transformation circuit receives external power from the input terminal and converts the external power into driving power, outputs the driving power through the output terminal, and the first end of the power cable is electrically connected to the output terminal; and a control circuit, electrically connected to the transformation circuit, and electrically connected to the two wires through the first end and the output terminal; wherein the control circuit detects the voltage division state between the two wires, and according to the voltage division state sends a switching signal the transformation circuit to change the driving power, the driving power is a pulse width modulation signal, and the switching signal is configured to change the duty cycle of the pulse width modulation signal.

7. The power supply device for light strings as claimed in claim 6, wherein the transformer further comprises a housing and at least two metal sheets, the transformation circuit and the control circuit are arranged in the housing, and the at least two metal sheets protrude from a surface of the housing and are connected to the input terminal.

8. The power supply device for light strings as claimed in claim 6, wherein:

the control circuit includes a power management chip, a switching controller, and a decoder; the switching controller is electrically connected to the power management chip and the decoder, and obtains operating power from the power management chip; the decoder is connected to the two wires; and the normally open contact switch is configured to be repeatedly pressed to change the voltage division state between the two wires to form a trigger signal combination, and the decoder is configured to analyze the trigger signal combination and sends corresponding information to the switching controller, so that the switching controller sends a switching signal to the transformation circuit to change the driving power according to the trigger signal combination.

9. The power supply device for light strings as claimed in claim 8, wherein:

the control circuit further includes a remote control signal receiver connected to the switching controller; the remote control signal receiver is configured to receive a plurality of remote control selection signals and transmit the remote control selection signals to the switching controller; wherein each of the remote control selection signals corresponds to a switching mode which enables the switching controller to send the switching signal to the transformation circuit to change the driving power.

10. The power supply device for light strings as claimed in claim 8, wherein the transformation circuit further includes an inverter corresponding to the input terminal and configured to convert the external power into a direct current, and the power management chip is electrically connected to the inverter to change a voltage of the direct current to output the direct current to be the driving power.

11. The power cable for the light string as claimed in claim 3, wherein the contact electrode is combined with the body to form a male plug, and the male plug is configured to insert into a socket of a transformer.

12. A power supply device for light strings, comprising:

the power cable according to claim 11; and the transformer, comprising:

a transformation circuit, including an input terminal and an output terminal, wherein the transformation circuit receives external power from the input terminal and converts the external power into driving power, outputs the driving power through the output terminal, and the first end of the power cable is electrically connected to the output terminal; and a control circuit, electrically connected to the transformation circuit, and electrically connected to the two wires through the first end and the output terminal; wherein the control circuit detects the voltage division state between the two wires, and according to the voltage division state sends a switching signal the transformation circuit to change the driving power, the driving power is a pulse width modulation signal, and the switching signal is configured to change the duty cycle of the pulse width modulation signal.

13. The power supply device for light strings as claimed in claim 12, wherein the transformer further comprises a housing and at least two metal sheets, the transformation circuit and the control circuit are arranged in the housing, and the at least two metal sheets protrude from a surface of the housing and are connected to the input terminal.

14. The power supply device for light strings as claimed in claim 12, wherein:

the control circuit includes a power management chip, a switching controller, and a decoder; the switching controller is electrically connected to the power management chip and the decoder, and obtains operating power from the power management chip; the decoder is connected to the two wires; and the normally open contact switch is configured to be repeatedly pressed to change the voltage division state between the two wires to form a trigger signal combination, and the decoder is configured to analyze the trigger signal combination and sends corresponding information to the switching controller, so that the switching controller sends a switching signal to the transformation circuit to change the driving power according to the trigger signal combination.

15. The power supply device for light strings as claimed in claim 14, wherein:

the control circuit further includes a remote control signal receiver connected to the switching controller; the remote control signal receiver is configured to receive a plurality of remote control selection signals and transmit the remote control selection signals to the switching controller; wherein each of the remote control selection signals corresponds to a switching mode which enables the switching controller to send the switching signal to the transformation circuit to change the driving power.

16. The power supply device for light strings as claimed in claim 14, wherein the transformation circuit further includes an inverter corresponding to the input terminal and configured to convert the external power into a direct current, and the power management chip is electrically connected to the inverter to change a voltage of the direct current to output the direct current to be the driving power.

* * * * *